US010000071B2

(12) United States Patent
Sasaki

(10) Patent No.: US 10,000,071 B2
(45) Date of Patent: Jun. 19, 2018

(54) RIBBON FEEDING APPARATUS, AND TAPE PRINTING APPARATUS EQUIPPED WITH THE SAME

(71) Applicant: SEIKO EPSON CORPORATION, Tokyo (JP)

(72) Inventor: Taishi Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/548,608

(22) PCT Filed: Jan. 12, 2016

(86) PCT No.: PCT/JP2016/000120

§ 371 (c)(1),
(2) Date: Aug. 3, 2017

(87) PCT Pub. No.: WO2016/125429

PCT Pub. Date: Aug. 11, 2016

(65) Prior Publication Data

US 2018/0022110 A1 Jan. 25, 2018

(30) Foreign Application Priority Data

Feb. 6, 2015 (JP) ..... 2015-022073

(51) Int. Cl.
*B41J 2/325* (2006.01)
*B41J 3/407* (2006.01)
*B41J 23/02* (2006.01)

(52) U.S. Cl.
CPC ..... *B41J 2/325* (2013.01); *B41J 3/4075* (2013.01); *B41J 23/02* (2013.01)

(58) Field of Classification Search
CPC ..... B41J 2/35; B41J 3/4075; B41J 23/02
See application file for complete search history.

(56) References Cited

U.S. PATENT DOCUMENTS

2005/0036812 A1* 2/2005 Carriere ..... B41J 3/4075 400/218

FOREIGN PATENT DOCUMENTS

JP 02-024177 A 1/1990
JP 2002-002053 A 1/2002
(Continued)

OTHER PUBLICATIONS

International Search Report dated Apr. 12, 2016 in International Appl. No. PCT/JP2016/000120 with English-language translation (2 pgs.).

*Primary Examiner* — Bradley Thies
(74) *Attorney, Agent, or Firm* — Foley & Lardner LLP

(57) ABSTRACT

An apparatus includes: a delivering-side gear train that transmits motive power to a delivering-side drive shaft; an winding-side gear train that transmits motive power to an winding-side drive shaft; a second clutch mechanism that connects the drive motor and the delivering-side gear train to each other in accordance with reverse rotation of the drive motor and disconnects the drive motor and the delivering-side gear train from each other in accordance with forward rotation of the drive motor; and a first clutch mechanism that is provided upstream of the second clutch mechanism, connects the drive motor and the winding-side gear train to each other in accordance with the forward rotation of the drive motor, and disconnects the drive motor and the winding-side gear train from each other in accordance with the reverse rotation of the drive motor.

4 Claims, 6 Drawing Sheets

(56) References Cited

FOREIGN PATENT DOCUMENTS

| | | | |
|---|---|---|---|
| JP | 2003-011454 | A | 1/2003 |
| JP | 2007-502221 | A | 2/2007 |

* cited by examiner

RIBBON FEEDING APPARATUS, AND TAPE PRINTING APPARATUS EQUIPPED WITH THE SAME

CROSS REFERENCE TO RELATED APPLICATIONS

This application is a national stage entry of International Application No. PCT/JP2016/000120, filed Jan. 12, 2016; which claims priority to Japanese Patent Application No. 2015-022073 filed on Feb. 6, 2015; the entire contents of which are incorporated by reference herein.

TECHNICAL FIELD

The present invention relates to a ribbon feeding apparatus that feeds an ink ribbon in a forward direction and a reverse direction, and a tape printing apparatus equipped with the same.

BACKGROUND ART

In prior art, as a tape printing apparatus (printer) of this kind, a known apparatus includes a two-way drive mechanism that feeds an ink ribbon in a feed direction and a reverse feed direction by driving, for rotation, a ribbon delivering core (ink ribbon supply spool) around which the ink ribbon is wound in such a way that it can be unreeled, and a ribbon winding core (ink ribbon taking-up spool) onto which the ink ribbon unreeled from the ribbon delivering core is reeled (see Patent Literature 1). The two-way drive mechanism includes: a drive motor, an ink ribbon supply gear that supports a ribbon supply shaft that is in engagement with the ribbon delivering core, an ink ribbon taking-up gear that supports a ribbon taking-up shaft that is in engagement with the ribbon winding core, and a pivotal drive gear assembly.

The pivotal drive gear assembly includes: a pivotal gear that is connected via a gear train to the drive motor, a gear plate that turns in an accompanying manner as the pivotal gear rotates, and a first moving gear and a second moving gear that are mounted rotatably on the gear plate. The first moving gear is in meshing engagement with the pivotal gear and is brought into and out of meshing engagement with the ink ribbon taking-up gear as the gear plate turns. The second moving gear is in meshing engagement with the first moving gear and is brought into and out of meshing engagement with the ink ribbon supply gear as the gear plate turns. In the two-way drive mechanism described above, when the drive motor is driven to rotate in the forward direction, the gear plate turns toward the ink ribbon taking-up gear to bring the first moving gear into meshing engagement with the ink ribbon taking-up gear. As a result of this operation, the drive motor and the ink ribbon taking-up gear get connected to each other via the gear train, and, in this state, the ribbon winding core is able to be driven to rotate by the drive motor. When the drive motor is driven to rotate in the reverse direction, the gear plate turns toward the ink ribbon supply gear to bring the second moving gear into meshing engagement with the ink ribbon supply gear. As a result of this operation, the drive motor and the ink ribbon supply gear get connected to each other via the gear train, and, in this state, the ribbon delivering core is able to be driven to rotate by the drive motor. In this way, it is possible to switch the connection to the drive motor between the ink ribbon taking-up gear and the ink ribbon supply gear in accordance with the forward and reverse rotation of the drive motor.

CITATION LIST

Patent Literature

Patent Literature 1: Japanese Unexamined Patent Application Publication (Translation of PCT Application) No. 2007-502221

SUMMARY OF INVENTION

Technical Problem

However, in the above tape printing apparatus according to prior art, the following problems arise when the connection to the drive motor is switched from the ink ribbon supply gear to the ink ribbon taking-up gear.

In a tape printing apparatus of this kind, it is common that a tension spring (torque limiter) for applying a predetermined tension to an ink ribbon is mounted between an ink ribbon supply gear and an ink ribbon taking-up gear. Therefore, in the above tape printing apparatus according to prior art, when the connection to the drive motor is switched from the ink ribbon supply gear to the ink ribbon taking-up gear, a force accumulated in the tension spring (slip torque) interferes with the pivotal gear via the ink ribbon supply gear, the second moving gear, and the first moving gear, thereby obstructing the rotation of the pivotal gear. Since this interference causes a time lag in the rotation of the pivotal gear and a time lag in the turning of the gear plate, it is impossible to perform the connection switchover speedily.

Moreover, in the above tape printing apparatus according to prior art, the tension applied to the ink ribbon is released suddenly at the timing when the second moving gear is brought out of meshing engagement with the ink ribbon supply gear. Therefore, loosening in the ink ribbon wound occurs.

An object of the present invention is to provide a ribbon feeding apparatus that makes it possible to, with a simple structure, solve problems arising when a connection to a drive motor is switched from a delivering side to an winding side, and provide a tape printing apparatus equipped with the same.

Solution to Problem

A ribbon feeding apparatus according to the present invention is an apparatus that feeds an ink ribbon in a forward direction and a reverse direction by driving a ribbon delivering core and a ribbon winding core for rotation, the ink ribbon being unreeled from the ribbon delivering core, the ink ribbon unreeled from the ribbon delivering core being reeled onto the ribbon winding core, the apparatus comprising: a drive motor; a delivering-side drive shaft that is in engagement with the ribbon delivering core; a delivering-side power transmission mechanism that transmits inputted motive power to the delivering-side drive shaft; an winding-side drive shaft that is in engagement with the ribbon winding core; an winding-side power transmission mechanism that transmits inputted motive power to the winding-side drive shaft; a delivering-side clutch mechanism that includes a sun gear and a planet gear, connects the drive motor and the delivering-side power transmission mechanism to each other in accordance with reverse rotation of the drive motor, and disconnects the drive motor and the delivering-side power transmission mechanism from each other in accordance with forward rotation of the drive motor, the planet gear being in meshing engagement with the sun gear and being brought into and out of meshing engagement with the winding-side power transmission mechanism; and an winding-side clutch mechanism that is provided upstream of the sun gear, connects the drive motor and the winding-side power transmission mechanism to each other in accordance with the forward rotation of the drive motor, and disconnects the drive motor and the winding-side power transmission mechanism from each other in accordance with the reverse rotation of the drive motor.

In this case, preferably, the winding-side clutch mechanism should include an winding-side sun gear that is provided upstream of the sun gear, and an winding-side planet gear that is in meshing engagement with the winding-side sun gear and is brought into and out of meshing engagement with the delivering-side power transmission mechanism.

A tape printing apparatus according to the present invention comprises the above ribbon feeding apparatus.

With the structure of these apparatuses, because of the separation of a clutch mechanism into the clutch mechanism at the delivering side (delivering-side clutch mechanism) and the clutch mechanism at the winding side (winding-side clutch mechanism), it is possible to establish a connection to the drive motor and release the connection at the winding-side clutch mechanism almost without any interference from the tension spring. Therefore, when the connection to the drive motor is switched from the delivering-side power transmission mechanism to the winding-side power transmission mechanism, it is possible to establish a speedy connection between the drive motor and the winding-side power transmission mechanism, thereby realizing speedy switchover from the delivering-side power transmission mechanism to the winding-side power transmission mechanism. Moreover, since the timing of activation of the winding-side clutch mechanism is slightly earlier than the timing of activation of the delivering-side clutch mechanism, the drive motor and the winding-side power transmission mechanism get connected to each other before the disconnection of the drive motor and the delivering-side power transmission mechanism from each other. That is, there exists a state of temporary connection to both of the power transmission mechanisms in the process of switchover. For this reason, the tension applied to the ink ribbon is released gradually, without a sudden release; therefore, it is possible to prevent the occurrence of loosening in the ink ribbon wound. As described herein, with a simple structure, it is possible to solve problems arising when the connection to the drive motor is switched from the delivering side to the winding side.

DESCRIPTION OF EMBODIMENTS

With reference to the accompanying drawings, a ribbon feeding apparatus according to an embodiment of the present invention, and a tape printing apparatus equipped with the same, will now be explained. The tape printing apparatus performs printing while delivering a printing tape and an ink ribbon from an attached tape cartridge, and cuts a printed part of the printing tape off to create a label (tape strip).

Figure 1:
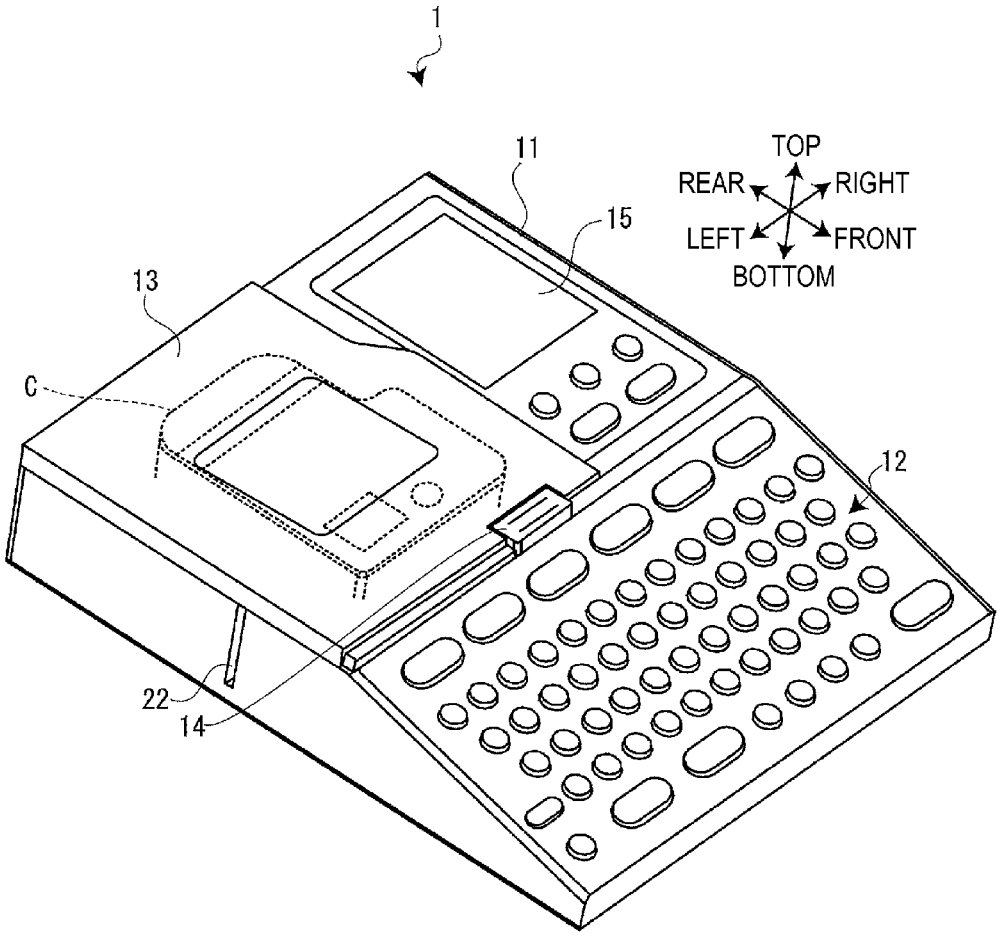
FIG. 1 An external perspective view of a tape printing apparatus according to an exemplary embodiment that is in a cover-closed state.
Figure 2:
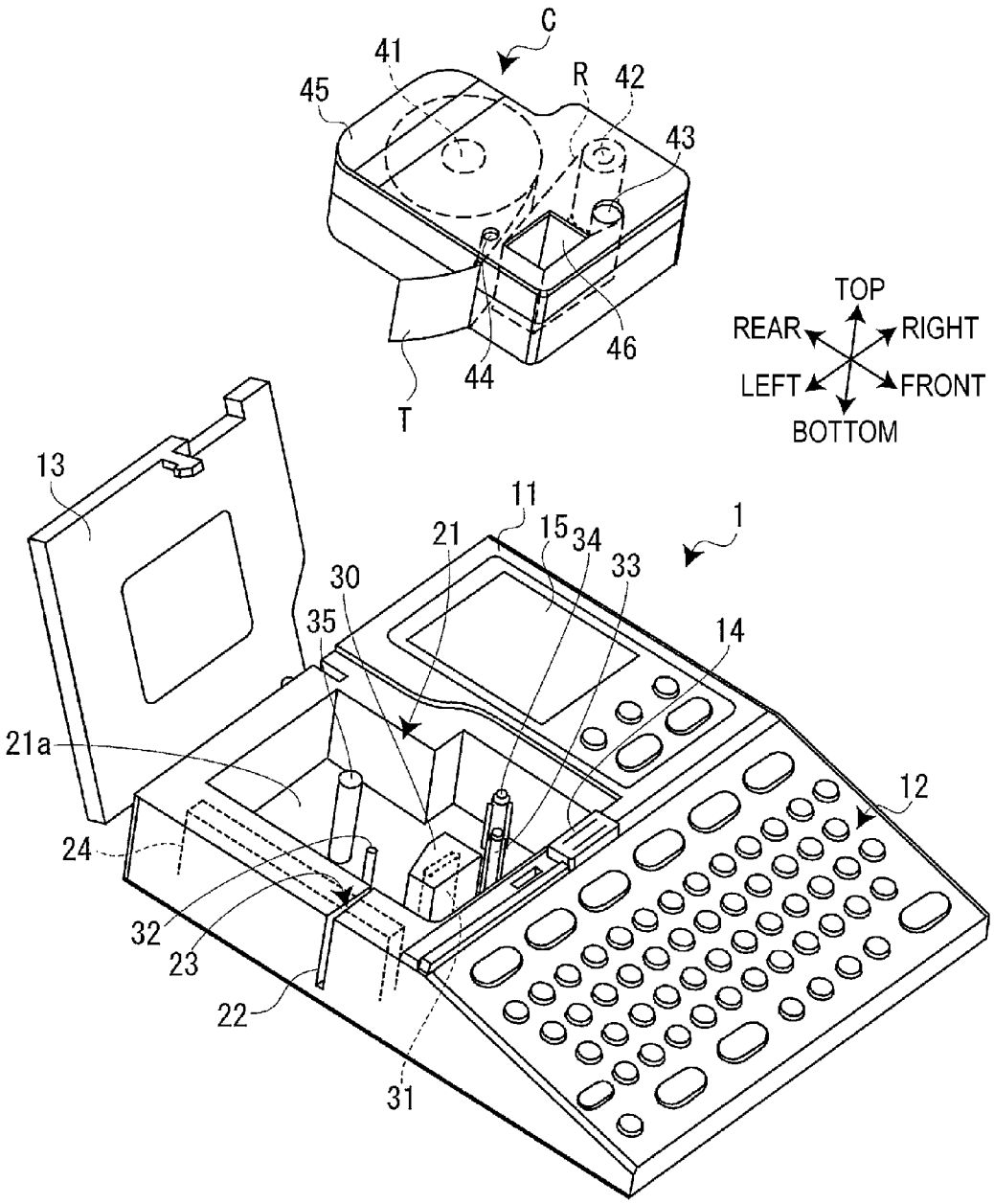
FIG. 2 An external perspective view of the tape printing apparatus that is in a cover-opened state.

As illustrated in FIGS. 1 and 2, the exterior of a tape printing apparatus 1 is made of an apparatus case 11, and a keyboard 12 including various keys is provided on the top of the front portion of the apparatus case 11. A wide open/close cover 13 is provided on the top, at the left-hand side, of the rear portion of the apparatus case 11, and a cover open button 14, which is for opening the open/close cover 13, is provided in front of the open/close cover 13. A rectangular display 15 for displaying the result of an input via the keyboard 12, etc. is provided on the top, at the right-hand side, of the rear portion of the apparatus case 11.

A cartridge attachment portion 21, into which a tape cartridge C is to be detachably attached, is formed as a cavity appearing inside when the cover open button 14 is pressed to open the open/close cover 13. The tape cartridge C is attached into the cartridge attachment portion 21 in a state in which the open/close cover 13 is open.

A tape exit 22, which is in communication with the cartridge attachment portion 21, is formed in the left side of the apparatus case 11, and a tape ejection path 23 is formed between the cartridge attachment portion 21 and the tape exit 22. A tape cutter 24 is built across the tape ejection path 23 inside the apparatus case 11.

Figure 3:
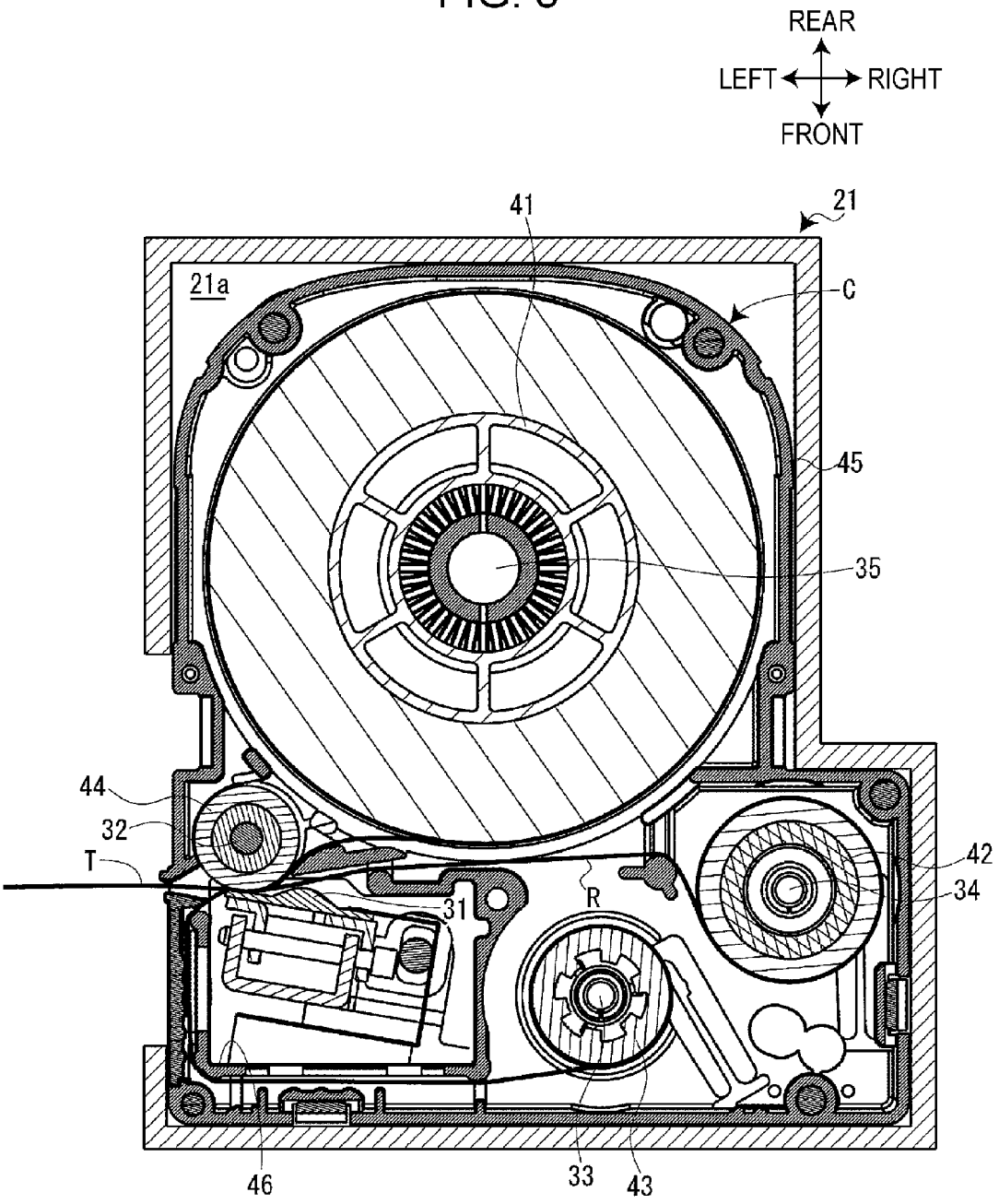
FIG. 3 A cross-sectional plan view of a cartridge attachment portion, and a tape cartridge attached to the cartridge attachment portion.

As illustrated in FIGS. 2 and 3, a thermal-type print head 31, which is housed in a head cover 30, a platen drive shaft 32, which is opposite to the print head 31, an winding-side drive shaft 33, which is in engagement with a ribbon winding core 43 described later, a delivering-side drive shaft 34, which is in engagement with a ribbon delivering core 42 described later, and a protrusion 35, which is for positioning a tape reel 41 described later, are provided in the cartridge attachment portion 21. FIG. 3 is a cross-sectional plan view taken at a middle position in the vertical direction of the tape cartridge C. The platen drive shaft 32, the winding-side drive shaft 33, and the delivering-side drive shaft 34 go through a bottom plate 21*a* of the cartridge attachment portion 21. A feeding power system 36 (see FIG. 4) for driving the platen drive shaft 32, the winding-side drive shaft 33, and the delivering-side drive shaft 34 for rotation is provided in a space under the bottom plate 21. A detailed explanation of the feeding power system 36 will be given later. A "ribbon feeding apparatus" is made up of the winding-side drive shaft 33, the delivering-side drive shaft 34, and the feeding power system 36.

The print head 31 is a thermal print head in which plural heat generation elements (not illustrated) are arranged vertically in lines. Specifically, ink on an ink ribbon R is thermally transferred on a dot-by-dot basis onto a printing tape T by individually driving each of the heat generation elements provided in the print head 31 for generation of heat in a state in which the printing tape T and the ink ribbon R are nipped between the print head 31 and a platen roller 44 described later.

On the other hand, the tape cartridge C includes: a tape reel 41, around which the printing tape T is wound in such a way that it can be unreeled, a ribbon delivering core 42, around which the ink ribbon R is wound in such a way that it can be unreeled, a ribbon winding core 43, onto which the ink ribbon R unreeled from the ribbon delivering core 42 is reeled, a platen roller 44, which is opposite to the print head 31, and a cartridge case 45, in which they are housed. A head opening 46, into which the head cover 30 is to be inserted, is formed through the cartridge case 45.

When the tape cartridge C is attached into the cartridge attachment portion 21, the head cover 30 is inserted into the head opening 46, and the positioning protrusion 35 is inserted into the center hole of the tape reel 41. In addition, at the same time, the center hole of the platen roller 44 is fitted onto the platen drive shaft 32, the center hole of the ribbon winding core 43 is fitted onto the winding-side drive shaft 33, and the center hole of the ribbon delivering core 42 is fitted onto the delivering-side drive shaft 34.

As illustrated in FIG. 3, the printing tape T is unreeled from the tape reel 41 into which the positioning protrusion 35 has been inserted. After passing through the position where the print head 31 and the platen roller 44 face each other, the printing tape T is fed to the tape ejection path 23 (tape feeding path). On the other hand, the ink ribbon R is unreeled from the ribbon delivering core 42 having been fitted onto the delivering-side drive shaft 34. After passing through the position where the print head 31 and the platen roller 44 face each other, the ink ribbon R goes around the surrounding walls of the head opening 46 to be reeled onto the ribbon winding core 43 having been fitted onto the winding-side drive shaft 33 (ribbon feeding path).

While nipping the printing tape T and the ink ribbon R by working together with the print head 31, the platen roller 44 having been fitted onto the platen drive shaft 32 feeds the printing tape T in the forward direction and the reverse direction by being driven to rotate. The ribbon winding core 43 having been fitted onto the winding-side drive shaft 33 is driven to rotate in synchronization with forward feeding by the platen roller 44, thereby taking up the ink ribbon R. The ribbon delivering core 42 having been fitted onto the delivering-side drive shaft 34 is driven to rotate in synchronization with reverse feeding by the platen roller 44, thereby taking up (rewinding) the ink ribbon R. By these drive rotations, the printing tape T and the ink ribbon R are fed in the forward direction and the reverse direction.

In label creation operation according to the present embodiment, first, the printing tape T and the ink ribbon R are fed in the reverse direction to bring the leading end portion of the printing tape T back to the print position where printing is to be performed by the print head 31. After that, print processing is performed onto the printing tape T by driving the print head 31 while feeding the printing tape T and the ink ribbon R in the forward direction. After completion of the print processing, the printed part of the printing tape T is cut off by means of the tape cutter 24. By this means, it is possible to create a label that has no white space arising from the distance between the head and the cutter.

Figure 4:
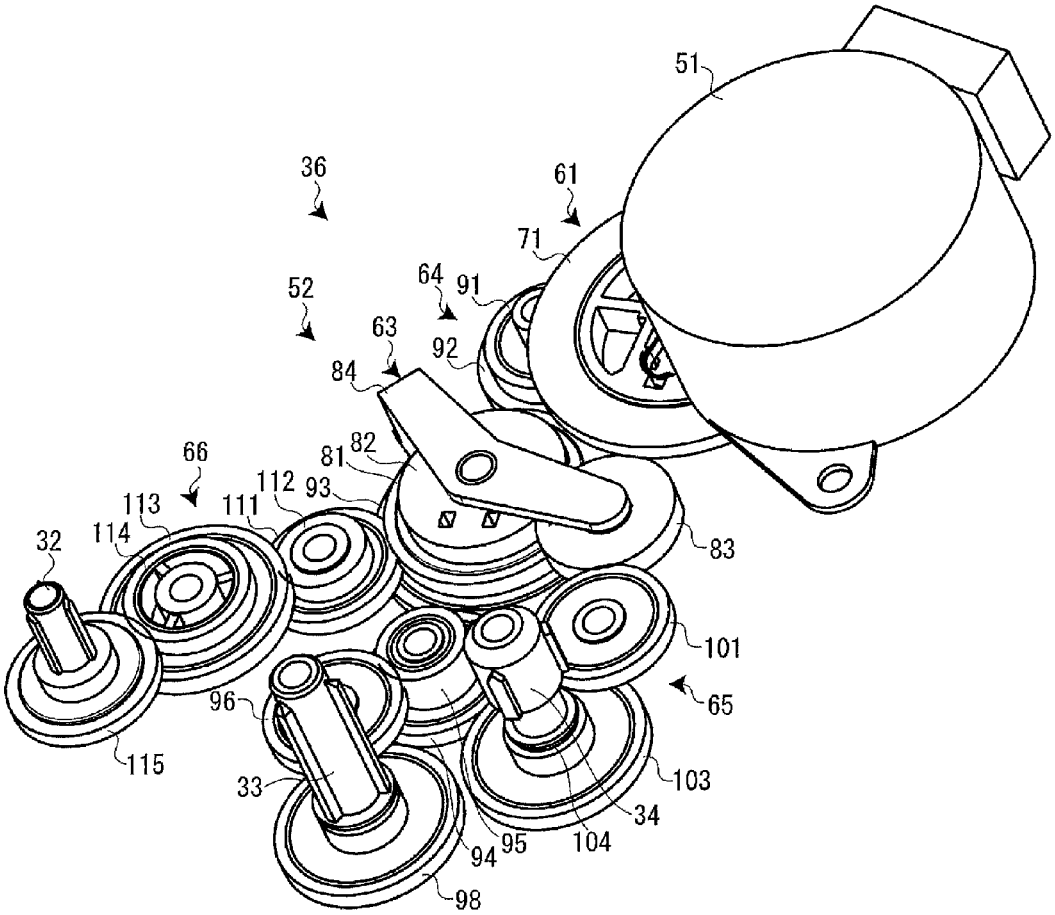
FIG. 4 A perspective view of a feeding power system.
Figure 5:
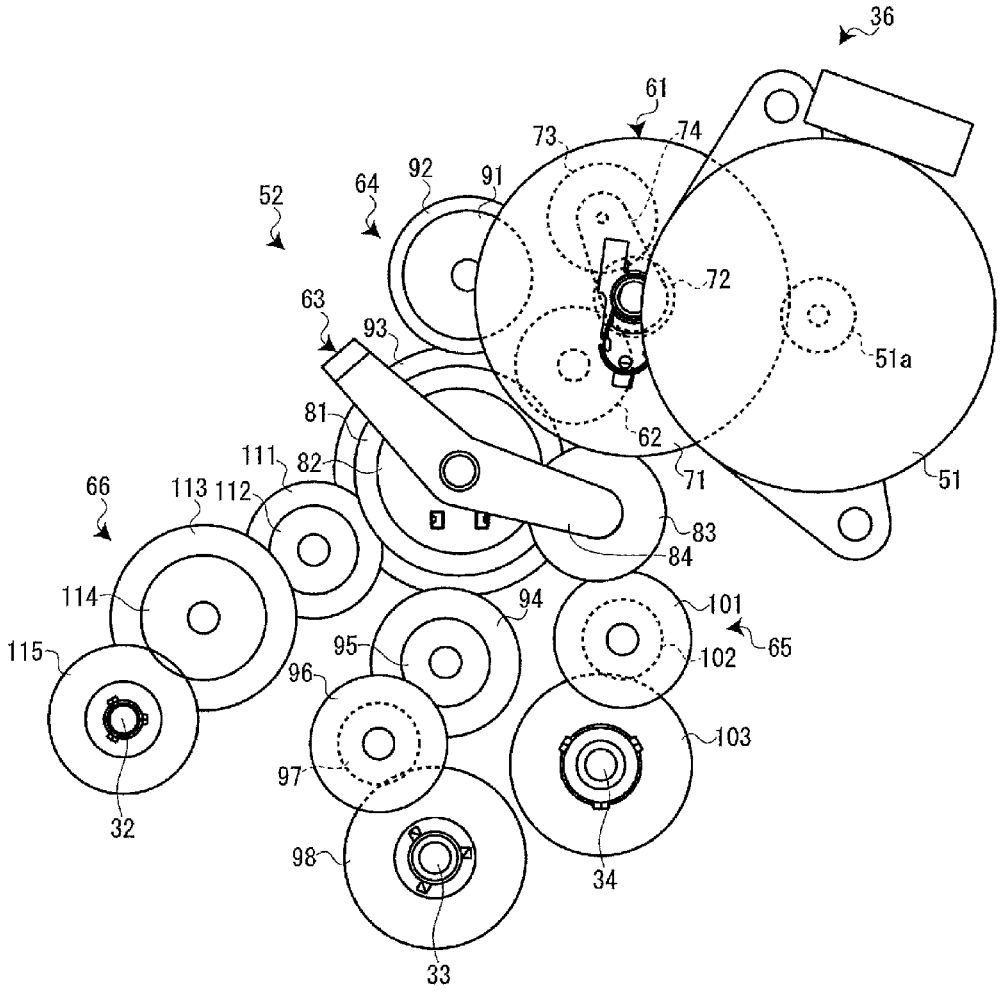
FIG. 5 A plan view of the feeding power system.

With reference to FIGS. 4 and 5, the feeding power system 36 will now be explained in detail. As illustrated in FIGS. 4 and 5, the feeding power system 36 includes a drive motor 51, which is a power source that is able to rotate in the forward direction and the reverse direction, and a power transmission mechanism 52, which transmits the rotational power of the drive motor 51 to the platen drive shaft 32, the winding-side drive shaft 33, and the delivering-side drive shaft 34. That is, in the present embodiment, the drive motor 51 is used as a shared drive source for the platen drive shaft 32, the winding-side drive shaft 33, and the delivering-side drive shaft 34. The drive motor 51 is controlled for switching between forward rotation driving and reverse rotation driving by a control unit.

The power transmission mechanism 52 includes a first clutch mechanism 61 (winding-side clutch mechanism), into which motive power is inputted from the drive motor 51, an intermediate gear 62, which is in meshing engagement with a sun gear 72 of the first clutch mechanism 61, and a second clutch mechanism 63 (delivering-side clutch mechanism), into which motive power is inputted from the intermediate gear 62. The power transmission mechanism 52 further includes an winding-side gear train 64 (winding-side power transmission mechanism), which transmits the inputted motive power to the winding-side drive shaft 33, an delivering-side gear train 65 (delivering-side power transmission mechanism), which transmits the inputted motive power to the delivering-side drive shaft 34, and a platen-side gear train 66, which transmits the inputted motive power to the platen drive shaft 32. The first clutch mechanism 61 establishes a connection between the drive motor 51 and the winding-side gear train 64, and releases the connection. The second clutch mechanism 63 establishes a connection between the drive motor 51 and the delivering-side gear train 65, and releases the connection. On the other hand, the platen-side gear train 66 is connected to a clutch input gear 81 of the second clutch mechanism 63 and is always connected to the drive motor 51.

The first clutch mechanism 61 includes a clutch input gear 71, a sun gear 72 (winding-side sun gear), a planet gear 73 (winding-side planet gear), and a carrier 74 (clutch lever). The clutch input gear 71 is in meshing engagement with a gear 51*a*, which is formed on the drive shaft of the drive motor 51. The sun gear 72 is fixed coaxially with the clutch input gear 71 under the clutch input gear 71. The planet gear 73 is in meshing engagement with the sun gear 72. The carrier 74 supports the planet gear 73 rotatably. In addition, the carrier 74 is supported coaxially with the sun gear 72 in such a way as to be able to turn in an accompanying manner. When the drive motor 51 is driven to rotate in the forward direction, the sun gear 72 rotates in the forward direction by being driven via the clutch input gear 71 due to this motor rotation. Because of this gear rotation in the forward direction, the carrier 74 turns toward the left in FIG. 5 (accompanying turn). This turn brings the planet gear 73, which is supported by the carrier 74, into meshing engagement with an input gear (winding-side input gear 91) of the winding-side gear train 64, thereby connecting the drive motor 51 and the winding-side gear train 64 to each other. On the other hand, when the drive motor 51 is driven to rotate in the reverse direction, the sun gear 72 rotates in the reverse direction by being driven via the clutch input gear 71 due to this motor rotation. Because of the rotation of the sun gear 72 in the reverse direction, the carrier 74 turns toward the right in FIG. 5 (accompanying turn). This turn brings the planet gear 73, which is supported by the carrier 74, out of meshing engagement with the winding-side input gear 91, thereby disconnecting the drive motor 51 and the winding-side gear train 64 from each other. In this way, the first clutch mechanism 61 establishes a connection between the drive motor 51 and the winding-side gear train 64, and releases the connection, in accordance with the forward and reverse rotation of the drive motor 51.

As mentioned above, the sun gear 72 of the first clutch mechanism 61 is in meshing engagement with the intermediate gear 62, and the sun gear 72 is connected via the intermediate gear 62 to the second clutch mechanism 63. Therefore, irrespective of whether the drive motor 51 is driven to rotate in the forward direction or the reverse direction, the motive power of the drive motor 51 is inputted into the second clutch mechanism 63 via the intermediate gear 62 from the sun gear 72.

The second clutch mechanism 63 includes a clutch input gear 81, a sun gear 82, a planet gear 83, and a carrier 84. The clutch input gear 81 is in meshing engagement with the intermediate gear 62. The sun gear 82 is fixed coaxially with the clutch input gear 81 upper the clutch input gear 81. The planet gear 83 is in meshing engagement with the sun gear 82. The carrier 84 supports the planet gear 83 rotatably. In addition, the carrier 84 is supported coaxially with the sun gear 82 in such a way as to be able to turn in an accompanying manner. When the drive motor 51 is driven to rotate in the reverse direction, the sun gear 82 rotates in the forward direction by being driven via the clutch input gear 71, the sun gear 72, the intermediate gear 62, and the clutch input gear 81 due to this motor rotation. Because of this gear rotation in the forward direction, the carrier 84 turns downward in FIG. 5 (accompanying turn). This turn brings the planet gear 83, which is supported by the carrier 84, into meshing engagement with an input gear (delivering-side input gear 101) of the delivering-side gear train 65, thereby connecting the drive motor 51 and the delivering-side gear train 65 to each other. On the other hand, when the drive motor 51 is driven to rotate in the forward direction, the sun gear 82 rotates in the reverse direction by being driven via the gears mentioned above due to this motor rotation. Because of the rotation of the sun gear 82 in the reverse direction, the carrier 84 turns upward in FIG. 5 (accompanying turn). This turn brings the planet gear 83, which is supported by the carrier 84, out of meshing engagement with the delivering-side input gear 101, thereby disconnecting the drive motor 51 and the delivering-side gear train 65 from each other. In this way, the second clutch mechanism 63 establishes a connection between the drive motor 51 and the delivering-side gear train 65, and releases the connection, in accordance with the forward and reverse rotation of the drive motor 51.

The winding-side gear train 64 includes an winding-side input gear 91, an winding-side first intermediate gear 92, an winding-side second intermediate gear 93, an winding-side third intermediate gear 94, an winding-side fourth intermediate gear 95, an winding-side fifth intermediate gear 96, an winding-side sixth intermediate gear 97, and an winding-side output gear 98. The winding-side input gear 91 is configured to be in meshing engagement with the planet gear 73 of the first clutch mechanism 61. The winding-side first intermediate gear 92 is fixed coaxially with the winding-side input gear 91 under the winding-side input gear 91. The winding-side second intermediate gear 93 is in meshing engagement with the winding-side first intermediate gear 92. The winding-side third intermediate gear 94 is in meshing engagement with the winding-side second intermediate gear 93. The winding-side fourth intermediate gear 95 is fixed coaxially with the winding-side third intermediate gear 94 over the winding-side third intermediate gear 94. The winding-side fifth intermediate gear 96 is in meshing engagement with the winding-side fourth intermediate gear 95. The winding-side sixth intermediate gear 97 is fixed coaxially with the winding-side fifth intermediate gear 96 under the winding-side fifth intermediate gear 96. The winding-side output gear 98 is in meshing engagement with the winding-side sixth intermediate gear 97, and supports the winding-side drive shaft 33. Because of the structure described above, motive power inputted into the winding-side input gear 91 from the planet gear 73 of the first clutch mechanism 61 is transmitted to the winding-side drive shaft 33. The winding-side second intermediate gear 93 is provided coaxially with the clutch input gear 81 and the sun gear 82 of the second clutch mechanism 63 directly under the clutch input gear 81. In addition, the winding-side second intermediate gear 93 is configured to be able to rotate independently of the clutch input gear 81 and the sun gear 82 of the second clutch mechanism 63.

A tension spring (torsion-spring-type torque limiter) (not illustrated) is mounted between the winding-side drive shaft 33 and the winding-side output gear 98. The winding-side drive shaft 33 is rotationally urged in the taking-up direction by the tension spring. This urging applies a predetermined tension to the ink ribbon R.

The delivering-side gear train 65 includes a delivering-side input gear 101, a delivering-side intermediate gear 102, and a delivering-side output gear 103. The delivering-side input gear 101 is configured to be in meshing engagement with the planet gear 83 of the second clutch mechanism 63. The delivering-side intermediate gear 102 is fixed coaxially with the delivering-side input gear 101 under the delivering-side input gear 101. The delivering-side output gear 103 is in meshing engagement with the delivering-side intermediate gear 102, and supports the delivering-side drive shaft 34. Because of the structure described above, motive power inputted into the delivering-side input gear 101 efrom the planet gear 83 of the second clutch mechanism 63 is transmitted to the delivering-side drive shaft 34. A tension spring 104 (torsion-spring-type torque limiter) is mounted between the delivering-side drive shaft 34 and the delivering-side output gear 103. The delivering-side drive shaft 34 is rotationally urged in the taking-up direction by the tension spring. This urging applies a predetermined tension to the ink ribbon R.

The platen-side gear train 66 includes a platen-side input gear 111, a platen-side first intermediate gear 112, a platen-side second intermediate gear 113, a platen-side third intermediate gear 114, and a platen-side output gear 115. The platen-side input gear 111 is in meshing engagement with the clutch input gear 81 of the second clutch mechanism 63. The platen-side first intermediate gear 112 is fixed coaxially with the platen-side input gear 111 over the platen-side input gear 111. The platen-side second intermediate gear 113 is in meshing engagement with the platen-side first intermediate gear 112. The platen-side third intermediate gear 114 is fixed coaxially with the platen-side second intermediate gear 113 over the platen-side second intermediate gear 113. The platen-side output gear 115 is in meshing engagement with the platen-side third intermediate gear 114, and supports the platen drive shaft 32. Because of the structure described above, motive power inputted into the platen-side input gear 111 from the clutch input gear 81 of the second clutch mechanism 63 is transmitted to the platen drive shaft 32.

Next, with reference to FIG. 6, forward feeding drive operation and reverse feeding drive operation performed by the feeding power system 36 will now be explained. First, with reference to FIG. 6(*a*), reverse feeding drive operation will now be explained. The reverse feeding drive operation is the operation of switching the connection to the drive motor 51 from the side of the winding-side drive shaft 33 to the side of the delivering-side drive shaft 34 by causing the drive motor 51 to rotate in the reverse direction and of causing the platen drive shaft 32 and the delivering-side drive shaft 34 to rotate. It is assumed herein that this operation is performed from a state in which the planet gear 73 has been brought into meshing engagement with the winding-side gear train 64 due to the turning of the carrier 74 of the first clutch mechanism 61 leftward in the drawing and in which the planet gear 83 has been brought out of meshing engagement with the delivering-side gear train 65 due to the turning of the carrier 84 of the second clutch mechanism 63 upward in the drawing.

Figure 6:
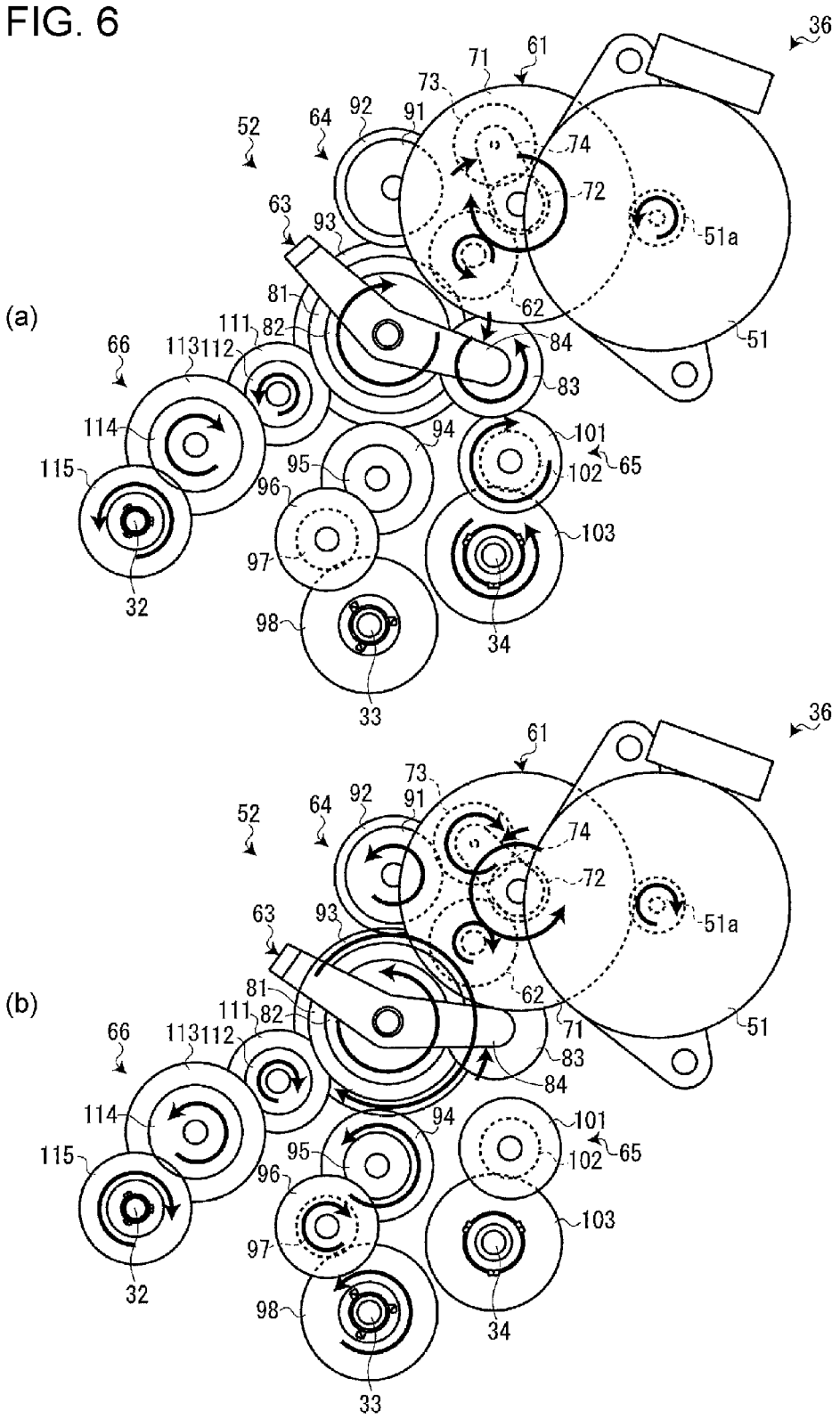
FIG. 6 (*a*) A diagram for explaining reverse feeding drive operation performed by the feeding power system; (*b*) A diagram for explaining forward feeding drive operation performed by the feeding power system.

As illustrated in FIG. 6(*a*), when the drive motor 51 is driven to rotate in the reverse direction, its power is inputted into the clutch input gear 71 of the first clutch mechanism 61. In the first clutch mechanism 61, the clutch input gear 71 rotates by receiving the inputted power, and the sun gear 72 fixed thereto rotates in the reverse direction. The rotation of the sun gear 72 in the reverse direction causes the carrier 74 to turn in an accompanying manner toward the right in the drawing, thereby bringing the planet gear 73 out of meshing engagement with the winding-side input gear 91 of the winding-side gear train 64. As a result of this operation, the connection between the drive motor 51 and the winding-side gear train 64 is released.

On the other hand, the motive power produced by the reverse rotation of the drive motor 51 is inputted into the clutch input gear 81 of the second clutch mechanism 63 via the intermediate gear 62 from the sun gear 72 of the first clutch mechanism 61.

In the second clutch mechanism 63, the clutch input gear 81 rotates by receiving the inputted power, and the sun gear 82 fixed thereto rotates in the forward direction. The rotation of the sun gear 82 in the forward direction causes the carrier 84 to turn in an accompanying manner downward in the drawing, thereby bringing the planet gear 83 into meshing engagement with the delivering-side input gear 101 of the delivering-side gear train 65. As a result of this operation, a connection between the drive motor 51 and the delivering-side gear train 65 is established. Because of this connection, the power of the drive motor 51 is transmitted to the delivering-side gear train 65, and then to the delivering-side drive shaft 34. Therefore, the delivering-side drive shaft 34 rotates due to the reverse rotation of the drive motor 51. Accordingly, the ribbon delivering core 42, which is in engagement with the delivering-side drive shaft 34, is driven to rotate in the taking-up direction.

In addition, the motive power produced by the reverse rotation of the drive motor 51 is inputted into the platen-side gear train 66 from the clutch input gear 81 of the second clutch mechanism 63. The motive power is transmitted via the platen-side gear train 66 to the platen drive shaft 32, and the platen drive shaft 32 rotates in the reverse direction. Because of this operation, the platen roller 44, which is in engagement with the platen drive shaft 32, is driven to rotate in the reverse direction. As described above, the driving of the platen roller 44 for rotation in the reverse direction and the driving of the ribbon delivering core 42 in the taking-up direction are performed at the same time in synchronization with each other. As a result of this operation, the printing tape T and the ink ribbon R are fed in the reverse direction.

Next, with reference to FIG. 6(*f*), forward feeding drive operation will now be explained. The forward feeding drive operation is the operation of switching the connection to the drive motor 51 from the side of the delivering-side drive shaft 34 to the side of the winding-side drive shaft 33 by causing the drive motor 51 to rotate in the forward direction and of causing the platen drive shaft 32 and the winding-side drive shaft 33 to rotate. It is assumed herein that this operation is performed from a state in which the planet gear 73 has been brought out of meshing engagement with the winding-side gear train 64 due to the turning of the carrier 74 of the first clutch mechanism 61 rightward in the drawing and in which the planet gear 83 has been brought into meshing engagement with the delivering-side gear train 65 due to the turning of the carrier 84 of the second clutch mechanism 63 downward in the drawing.

As illustrated in FIG. 6(*b*), when the drive motor 51 is driven to rotate in the forward direction, its power is inputted into the clutch input gear 71 of the first clutch mechanism 61. In the first clutch mechanism 61, the clutch input gear 71 rotates by receiving the inputted power, and the sun gear 72 fixed thereto rotates in the forward direction. The rotation of the sun gear 72 in the forward direction causes the carrier 74 to turn in an accompanying manner toward the left in the drawing, thereby bringing the planet gear 73 into meshing engagement with the winding-side input gear 91 of the winding-side gear train 64. As a result of this operation, a connection between the drive motor 51 and the winding-side gear train 64 is established. Because of this connection, the power of the drive motor 51 is transmitted to the winding-side gear train 64, and then to the winding-side drive shaft 33. Therefore, the winding-side drive shaft 33 rotates due to the forward rotation of the drive motor 51. Accordingly, the ribbon winding core 43, which is in engagement with the winding-side drive shaft 33, is driven to rotate in the taking-up direction.

On the other hand, the motive power produced by the forward rotation of the drive motor 51 is inputted into the clutch input gear 81 of the second clutch mechanism 63 via the intermediate gear 62 from the sun gear 72 of the first clutch mechanism 61.

In the second clutch mechanism 63, the clutch input gear 81 rotates by receiving the inputted power, and the sun gear 82 fixed thereto rotates in the reverse direction. The rotation of the sun gear 82 in the reverse direction causes the carrier 84 to turn in an accompanying manner upward in the drawing, thereby bringing the planet gear 83 out of meshing engagement with the delivering-side input gear 101 of the delivering-side gear train 65. As a result of this operation, the connection between the drive motor 51 and the delivering-side gear train 65 is released.

In addition, the motive power produced by the forward rotation of the drive motor 51 is inputted into the platen-side gear train 66 from the clutch input gear 81 of the second clutch mechanism 63. The motive power is transmitted via the platen-side gear train 66 to the platen drive shaft 32, and the platen drive shaft 32 rotates in the forward direction. Because of this operation, the platen roller 44, which is in engagement with the platen drive shaft 32, is driven to rotate in the forward direction. As described above, the driving of the platen roller 44 for rotation in the forward direction and the driving of the ribbon winding core 43 in the taking-up direction are performed at the same time in synchronization with each other. As a result of this operation, the printing tape T and the ink ribbon R are fed in the forward direction.

With the structure described above, because of the separation of a clutch mechanism into the first clutch mechanism 61 and the second clutch mechanism 63, it is possible to establish a connection to the drive motor 51 and release the connection at the first clutch mechanism 61 almost without any interference from the delivering-side tension spring 104. Therefore, when the connection to the drive motor 51 is switched from the side of the delivering-side drive shaft 34 to the side of the winding-side drive shaft 33, it is possible to establish a speedy connection between the drive motor 51 and the winding-side gear train 64, thereby realizing speedy switchover from the side of the delivering-side drive shaft 34 to the side of the winding-side drive shaft 33. In particular, in a case where, as in the embodiment described above, print processing is performed by feeding the printing tape T in the forward direction after bringing the leading end portion of the printing tape T back to the print position where printing is to be performed by the print head 31 by feeding the printing tape T in the reverse direction, it is possible to proceed into the print processing immediately after the pulling of the leading end portion of the printing tape T back.

Moreover, since the timing of activation of the first clutch mechanism 61 is slightly earlier than the timing of activation of the second clutch mechanism 63, the drive motor 51 and the winding-side gear train 64 get connected to each other before the disconnection of the drive motor 51 and the delivering-side gear train 65 from each other. That is, there exists a state of temporary connection to both of the gear trains 64 and 65 in the process of switchover. For this reason, the tension applied to the ink ribbon R is released gradually, without a sudden release; therefore, it is possible to prevent the occurrence of loosening in the ink ribbon R wound. As described herein, with a simple structure, it is possible to solve problems arising when the connection to the drive motor 51 is switched from the delivering side to the winding side.

In the embodiment described above, the winding-side first clutch mechanism 61 is provided upstream of the sun gear 82 of the delivering-side second clutch mechanism 63. However, the delivering-side second clutch mechanism 63 may be provided upstream of the sun gear 72 of the winding-side first clutch mechanism 61. That is, although a priority is given to the solution of problems (e.g., delay in switchover) arising when the connection to the drive motor 51 is switched from the delivering side to the winding side in the embodiment described above, similar problems could arise in switchover from the winding side to the delivering side because a tension spring is mounted on the winding-side drive shaft 33, too. A conceivable structure for addressing this issue is to give a priority to the solution of problems arising in switchover from the winding side to the delivering side and to provide the delivering-side second clutch mechanism 63 upstream of the sun gear 72 of the winding-side first clutch mechanism 61.

A second gear train branching off from the gear train leading to the delivering-side second clutch mechanism 63 may be provided, and the winding-side first clutch mechanism 61 may be provided on the second gear train. That is, the gear train may bifurcate upstream of each of the clutch mechanisms 61 and 63, and each of the clutch mechanisms 61 and 63 may be provided on the corresponding one of the two branch gear trains. With such a structure, it is possible to establish a connection between the drive motor 51 and the winding-side gear train 64 at the first clutch mechanism 61 almost without any interference from the tension spring 104 mounted on the delivering-side drive shaft 34 when the connection to the drive motor 51 is switched from the delivering side to the winding side. Moreover, it is possible to establish a connection between the drive motor 51 and the delivering-side gear train 65 at the second clutch mechanism 63 almost without any interference from the tension spring mounted on the winding-side drive shaft 33 when the connection to the drive motor 51 is switched from the winding side to the delivering side. Therefore, it is possible to solve problems arising when the connection to the drive motor 51 is switched from the delivering side to the winding side and, at the same time, it is possible to solve problems arising when the connection to the drive motor 51 is switched from the winding side to the delivering side.

REFERENCE SIGNS LIST

33: winding-side drive shaft
34: delivering-side drive shaft
36: feeding power system
42: ribbon delivering core
43: ribbon winding core
51: drive motor
61: first clutch mechanism
63: second clutch mechanism
64: winding-side gear train
65: delivering-side gear train
82: sun gear
83: planet gear
R: ink ribbon

The invention claimed is:

1. A ribbon feeding apparatus that feeds an ink ribbon in a forward direction and a reverse direction by driving a ribbon delivering core and a ribbon winding core for rotation, the ink ribbon being unreeled from the ribbon delivering core, the ink ribbon unreeled from the ribbon delivering core being reeled onto the ribbon winding core, the apparatus comprising:

a drive motor;

a delivering-side drive shaft that is in engagement with the ribbon delivering core;

a delivering-side power transmission mechanism that transmits inputted motive power to the delivering-side drive shaft;

an winding-side drive shaft that is in engagement with the ribbon winding core;

an winding-side power transmission mechanism that transmits inputted motive power to the winding-side drive shaft;

a delivering-side clutch mechanism that includes a sun gear and a planet gear, connects the drive motor and the delivering-side power transmission mechanism to each other in accordance with reverse rotation of the drive motor, and disconnects the drive motor and the delivering-side power transmission mechanism from each other in accordance with forward rotation of the drive motor, the planet gear being in meshing engagement with the sun gear and being brought into and out of meshing engagement with the winding-side power transmission mechanism; and an winding-side clutch mechanism that is provided upstream of the sun gear, connects the drive motor and the winding-side power transmission mechanism to each other in accordance with the forward rotation of the drive motor, and disconnects the drive motor and the winding-side power transmission mechanism from each other in accordance with the reverse rotation of the drive motor.

2. The ribbon feeding apparatus according to claim 1, wherein the winding-side clutch mechanism includes an winding-side sun gear that is provided upstream of the sun gear, and an winding-side planet gear that is in meshing engagement with the winding-side sun gear and is brought into and out of meshing engagement with the delivering-side power transmission mechanism.

3. A tape printing apparatus, comprising:

the ribbon feeding apparatus according to claim 2.

4. A tape printing apparatus, comprising:

the ribbon feeding apparatus according to claim 1.

* * * * *